United States Patent [19]

Smith et al.

[11] Patent Number: 4,838,701

[45] Date of Patent: Jun. 13, 1989

[54] MIXER

[75] Inventors: D. W. Smith, Tulsa; R. D. Kennedy, Wagoner, both of Okla.; E. C. Garcia, Fabens, Tex.

[73] Assignee: Dowell Schlumberger Incorporated, Tulsa, Okla.

[21] Appl. No.: 188,126

[22] Filed: Apr. 25, 1988

Related U.S. Application Data

[63] Continuation of Ser. No. 869,559, Jun. 2, 1986, abandoned.

[51] Int. Cl.[4] ..... B01F 15/02; B28C 7/12; B28C 7/16

[52] U.S. Cl. ..... 366/136; 366/27; 366/34; 366/51; 366/165

[58] Field of Search ..... 366/165, 181, 136, 182, 366/137, 131, 167, 30, 173, 150, 154, 28, 27, 33, 34, 40, 42, 51

[56] References Cited

U.S. PATENT DOCUMENTS

| | | | |
|---|---|---|---|
| 2,528,514 | 11/1950 | Harvey et al. | 366/173 X |
| 3,201,093 | 8/1965 | Smith | 366/167 X |
| 3,256,181 | 6/1966 | Zingg et al. | 366/142 X |
| 3,261,593 | 7/1966 | Sharples | 366/165 |
| 3,741,533 | 6/1973 | Winn, Jr. | 366/136 X |
| 3,856,269 | 12/1974 | Fothergill et al. | 366/165 |
| 4,007,921 | 2/1977 | Zingg | 366/136 X |
| 4,125,331 | 11/1978 | Chisholm | 366/136 X |
| 4,498,819 | 2/1985 | El-Saie | 366/165 X |
| 4,616,935 | 10/1986 | Harrison et al. | 366/165 |

*Primary Examiner*—Harvey C. Hornsby
*Assistant Examiner*—Scott J. Haugland
*Attorney, Agent, or Firm*—S. A. Littlefield; D. B. Deioma

[57] ABSTRACT

A mixer suitable for mixing a particulate material with a liquid. The mixer has a particulate material conduit, and a volute chamber disposed about the conduit. The volute chamber has a liquid inlet and an open lower end through which the particulate material conduit extends, to define an annular liquid outlet of the volute chamber. A transition cone communicates with the liquid outlet of the volute chamber and extends downward from it. At least a portion of the transition cone tapers inward while extending downward from a position not substantially lower than an outlet at the lower end of the conduit, to a position which is not substantially thereabove. Preferably the transition cone tapers as described, from a position above the conduit outlet to a position therebelow. A substantially straight downpipe is connected to, and extends downward from, a lower end of the transition cone. A mixing apparatus includes a mixer of the foregoing type, wherein the downpipe extends downward to a position spaced above the bottom wall of the tank.

14 Claims, 3 Drawing Sheets

MIXER

This is a continuation of application Ser. No. 869,559, filed on June 2, 1986, now abandoned.

FIELD OF THE INVENTION

This invention relates to a mixer particularly suitable for mixing particulate material with a liquid.

TECHNOLOGY REVIEW

In many applications, such as those relating to oil well servicing, it is necessary to mix large amounts of a dry particulate material with a liquid. One such situation is in the mixing of cement slurry. Broadly, such mixing can be accomplished using either a batch or continuous process. A general problem with batch mixers is that they must have a large mixture reservoir. This tends to make batch mixers bulky and heavy, and therefore difficult to transport to various sites. Furthermore, such mixers require considerable clean-up time, and in addition, do not readily permit rapid change in the characteristics of the mixture produced.

A number of continuous mixtures, particularly for mixing cement slurries, have been known in the past. For example, U.S. Pat. No. 3,298,669 to Zingg discloses a mixer which utilizes a venturi effect to educt the solid particulate material into the liquid. The particulate material is fed through a frusto-conical cone, the outlet of which is disposed within another frusto-conical cone. The annular space between the two cones forms a passage through which the liquid flows to educt the particulate material from the inner frusto-conical member. An annular air passage is also provided around the outlet of the inner frusto-conical member, in an attempt to create a layer of air between the liquid and particulate material being educted thereinto. The air passage is provided to prevent the liquid from splashing back to the inner frusto-conical member, and possibly resulting in plugging to wetting of the particulate material.

U.S. Pat. No. 3,201,093 to Smith discloses a mixer having a vortex forming chamber into which the liquid may be tangentially directed. The chamber has a lower central opening, which in one embodiment may have a straight outlet pipe extending downward therefrom. The particulate material is delivered through a conduit coaxial with the vortex forming chamber outlet, the outlet of which conduit may be positioned above the chamber, or within the downwardly extending outlet pipe. The entire apparatus is positioned above, and adjacent to, a baffle plate or tank bottom. In operation, liquid from the vortex in the chamber would exit through the liquid conduit or opening in the bottom of the chamber and draw the particulate material therewith. However, as made clear in the patent, the baffle or tank bottom was sufficiently close to the outlet conduit or outlet of the vortex forming chamber, such that substantially no mixing took place until the liquid and solid impinged upon the baffle plate or tank bottom. Thus, mixing was accomplished by the shear which resulted upon liquid and particles impinging upon the baffle or tank bottom at an angle.

U.S. Pat. No. 3,256,181 and U.S. Pat. No. 3,326,563, both at Zingg et al., also disclose a continuous mixing method and apparatus for accomplishing the same. The apparatus of both patents includes a pump which pumps the liquid into a circular chamber. An impeller is rotatably disposed in such chamber and a hopper provided to feed the particulate material onto the rotating impeller. The resulting mixture is discharged through an outlet which exits the chamber tangentially. Such apparatus of course does not rely upon any vortex effect produced by the liquid itself, to aid in mixing the particulate material.

U.S. Pat. No. 3,741,533 discloses a mixing apparatus using a central particulate material conduit, and concentric liquid material conduit in the form of an outer tubular element. A first cylindrical liquid chamber is provided in communication with an upper end of the liquid conduit, while a second cylindrical chamber communicates with an upper end of the tubular element and is disposed about the liquid conduit between its lower and upper ends. In one embodiment wherein the liquid inlet is directed tangentially into the first cylindrical chamber, the outlets of the conduits and tubular element are sufficiently close to the bottom of the tank such that mixing takes place as a result of shear action when the particulate material, liquid, and recirculated slurry impinge upon the tank bottom. In another embodiment, the lower ends of the particulate material and liquid conduits are disposed upwardly within the outer tubular element. In such embodiment, the liquid enters the cylindrical liquid chamber in a radial direction such that a sheet of liquid is formed between the dry bulk material leaving the particulate material conduit and the recirculated slurry.

U.S. Pat. No. 4,125,331 to Chisholm, discloses an apparatus somewhat similar to that of U.S. Pat. No. 3,741,533. However, in the apparatus of the former patent, the liquid conduit is provided with an inwardly tapered lower portion. The innermost particle conduit can be raised and lowered within the liquid conduit, between a lower level with a lowermost end adjacent to and abutting a lowermost end of the liquid conduit, and a position thereabove to control fluid flow. The patent makes it clear that liquid which leaves the lower most end of the tapered portion of the liquid conduit is immediately forced to swirl outwardly due to centrifugal force. Of course, such outward and downward swirling or spiralling results since the lower end of the tapered portion is open, with no straight downwardly extending pipe section communicating therewith.

U.S. Pat. No. 4,007,721 to Zingg discloses a blender apparatus, which includes a first circular chamber into which a liquid is fed in a radially upward direction to produce a sheet of liquid which then mixes with dry particulate material from a hopper. The foregoing mixture is fed into one arm of a tangentially directed inlet of a volute chamber disposed within a slurry storage tank. Another arm of the inlet has a nozzle disposed therein for receiving recirculated slurry from the tank and directing it into the inlet of the volute. The patent indicates that as a result of the recirculation of slurry through the nozzle into the volute chamber within the tank, continuous circulation of the slurry mixture within the tank takes place.

None of the mixers of the above patents provides a particulate conduit disposed within an inwardly tapered liquid conduit to define an annular liquid outlet therebetween, through which liquid can pass in a vortex manner from a volute chamber, and into a straight downpipe.

SUMMARY OF THE INVENTION

The present invention provides a mixer which includes a particulate material conduit with an upper inlet and a lower outlet. A volute chamber (that is, any chamber shaped to produce a vortex in a liquid directed tangentially thereinto) is disposed about the particulate material conduit at a position between the inlet and outlet of it. The volute chamber has a tangentially directed liquid inlet, and an open lower end, through which the particulate material conduit extends. The foregoing open lower end and particulate material conduit together define an annular liquid outlet. The liquid inlet and outlet are disposed such that liquid entering the liquid inlet at sufficient velocity can leave the liquid outlet in the form of a vortex. A transition cone extends downward from the liquid outlet of the volute chamber. At least a portion of the transition cone tapers inward while extending downward from a position not substantially lower than the particulate material conduit outlet, and preferably thereabove, to a position which is not substantially above the particulate material conduit outlet and preferably therebelow. A substantially straight downpipe extends downward from a lower end of the transition cone. The particulate material conduit, volute chamber, transition cone, and downpipe are preferably are all coaxial.

A liquid conduit can additionally be provided which communicates with the liquid inlet of the volute chamber. Such liquid conduit preferably has a first leg, as well as a nozzle disposed in the first leg, preferably coaxially with the liquid inlet of the volute chamber. In any event, the nozzle is aimed at the liquid inlet of the volute chamber so as to direct fluid flowing in the first leg into the liquid inlet thereof.

Mixers of the foregoing types are preferably used as a portion of a mixing apparatus. Such apparatus would typically include a tank with a bottom wall and a mixture outlet. The lower end of the pipe extending downward from the liquid outlet of the volute chamber, is spaced above the bottom wall a sufficient distance such that during operation of the apparatus to produce a vortex in the pipe, no substantial splashback will occur from the bottom wall of the tank into the pipe.

Drawings

Embodiments of the invention will now be described with reference to the drawings in which.

Figure 5:
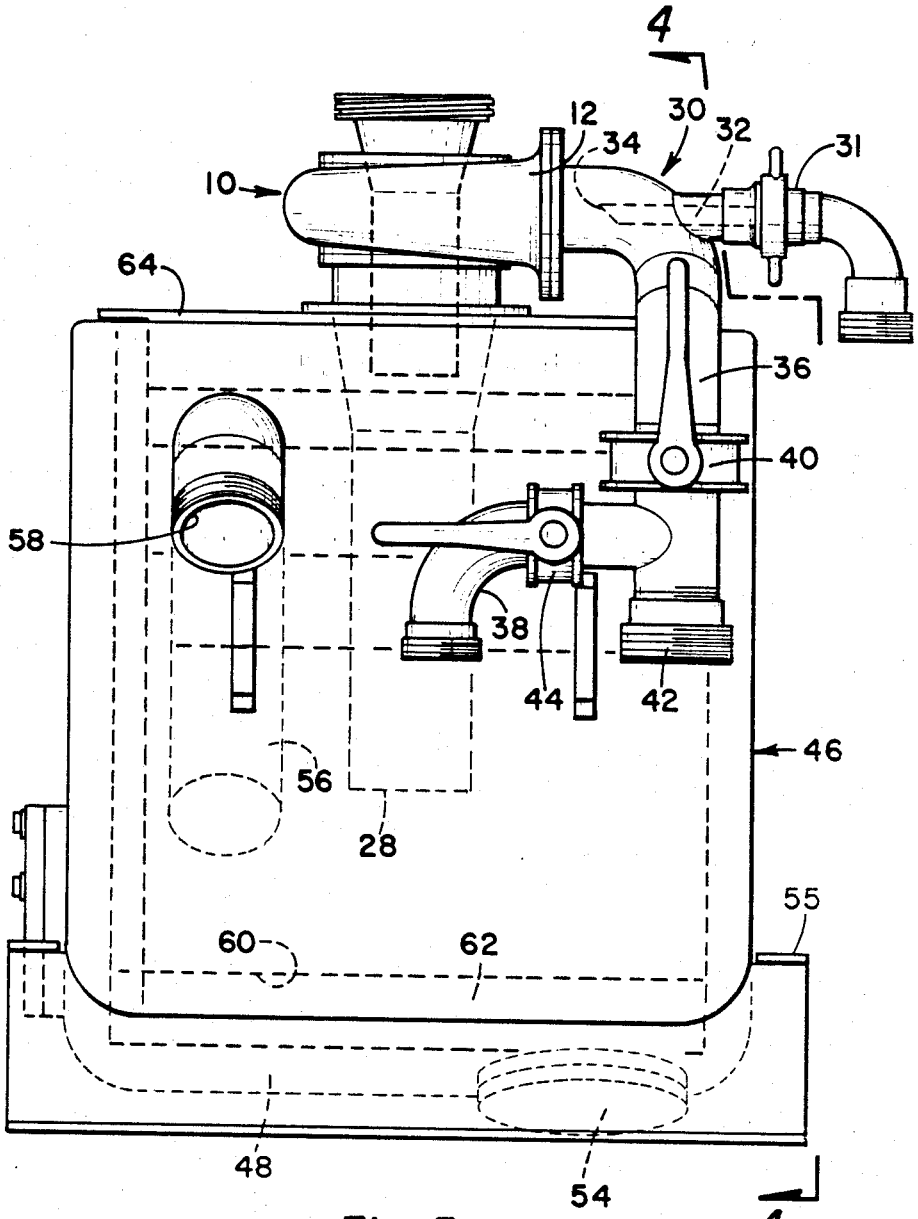

FIG. 5 as a front side elevation thereof.

DETAILED DESCRIPTION OF EMBODIMENTS

Figure 3:
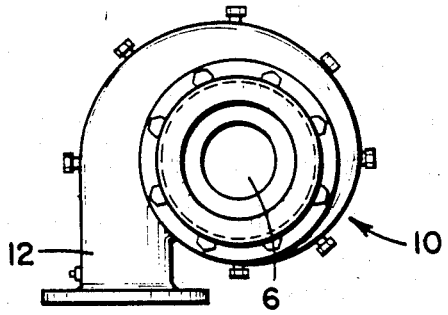
FIG. 3 is a top view thereof.
Figure 1:
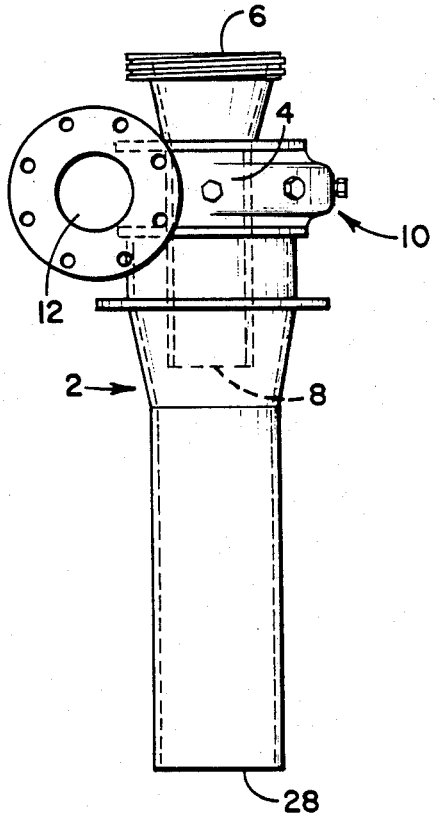
FIG. 1 is a right side elevation of a mixer of the present invention.
Figure 2:
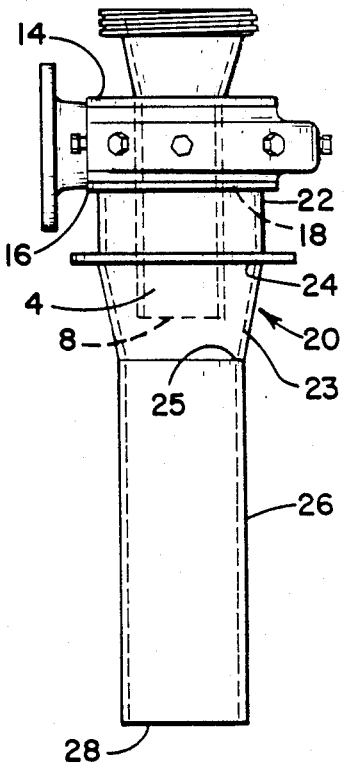
FIG. 2 is a rear elevation thereof.

Referring first to FIGS. 1–3, a mixer of the present invention will now be described. The mixer shown is designated by reference 2, and includes a particulate material conduit 4 with a particulate material inlet 6 at an upper end, and a particulate material outlet 8 at a lower end. A volute chamber 10 is disposed about the conduit 4 at a position between the inlet 6 and outlet 8. The volute chamber has tangential liquid inlet 12, an upper end 14 which is closed about conduit 4, and an open lower end 16 through which conduit 4 extends to define an annular liquid outlet 18 of volute 10. As a result of the foregoing arrangement, liquid entering liquid inlet 12 at sufficient velocity can leave outlet 18 in the form of a vortex.

The mixer further includes a transition cone 20 communicating with outlet 18 and extending downward from it. Transition cone 20 has a portion 22 which extends straight down from outlet 18, and a tapered portion 23 at a lower end of transition cone 20. As will be seen particularly well from FIGS. 1 and 2, portion 23 of transition cone 20 tapers inward while extending downward from a position above particulate material conduit outlet 8, to a position below outlet 8. Portion 23 tapers inwardly at an acute angle as measured from the axis of transition cone 20. A straight downpipe 26 is connected to, and extends downward from, a lower end 25 of transition cone 20. As will be seen from FIGS. 1 and 2, downpipe 26 is longer than the tapered portion 23 of transition cone 20. In particular, downpipe 26 is between about 3 to 4 times the length of portion 23.

Figure 4:
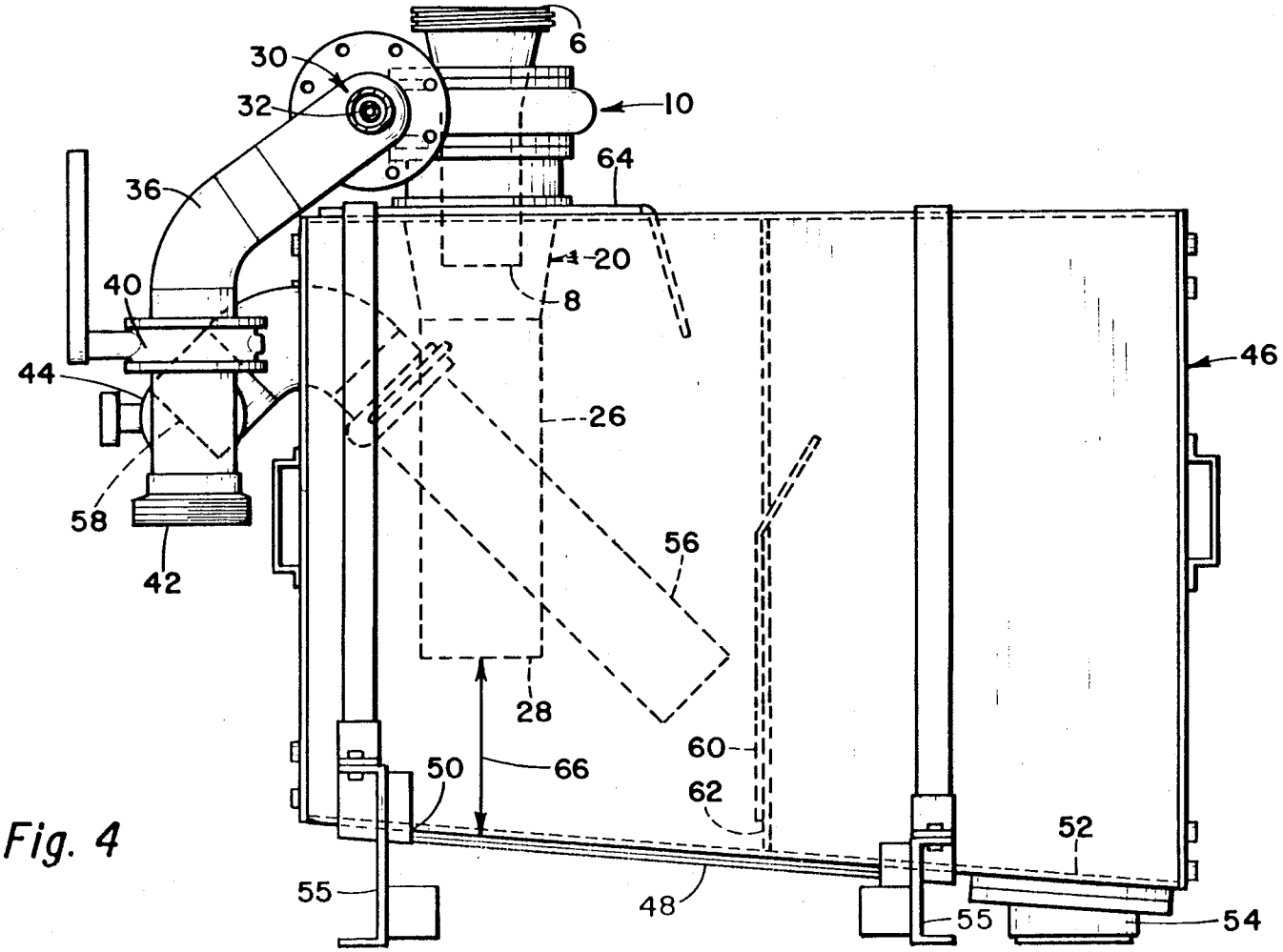
FIG. 4 is a right side elevation of a mixing apparatus of the present invention, and which includes the mixer of FIGS. 1–3.

Referring to FIGS. 4 and 5, a mixing apparatus is shown which uses the mixer 2 of FIGS. 1–3. In addition though, mixer 2 as shown in FIGS. 4 and 5, is provided with a liquid conduit 30. Conduit 30 has a first leg 31 and a nozzle 32 disposed in first leg 31. Nozzle 32 is coaxial with liquid inlet 12 of volute chamber 10 and is aimed at inlet 12 so as to direct fluid flowing in first leg 31 into liquid inlet 12.

Liquid conduit 30 also has a second leg 36 with a by-pass arm 38, manually operable valves 40, 44 and an inlet 42, the function of all of which shall become apparent shortly. The mixing apparatus further includes a tank 46 having a sloping bottom wall 48, with upper and lower ends 50, 52, respectively. A mixture outlet 54 communicates with the interior of tank 46 through the lower end 52 of bottom wall 48 thereof. Brackets 55 are provided to mount tank 46 in an upright position as illustrated in FIGS. 4 and 5. A recirculation pipe 56, having an inlet 58, extends through an end wall of tank 46 to communicate with the interior of tank 46. A baffle 60 is disposed approximately midway between the ends of bottom wall 48. Baffle 60 is raised slightly above bottom wall 48 to create a baffle by-pass space 62. Mixer 2 is mounted on a cover portion 64 of tank 46, with outlet 28 of downpipe 26 being spaced a distance 66 above bottom wall 48, in particular above a portion adjacent upper end 50 thereof. Distance 66 is sufficient such that during normal operation of the mixing apparatus no substantial splashback of liquid exiting outlet 28 will occur from bottom wall 48, back into downpipe 26. For example, distance 66 could be approximately 8 inches.

Operation of the above-described mixing apparatus, to mix a dry particulate material, in particular dry cement power, with a liquid, in particular water, to produce a cement slurry, will now be described. However, it will be understood that the apparatus might be used for mixing other particulate materials, especially dry particulate materials, with a liquid. In operation, then, first leg 31 of inlet conduit 30 is connected to a source of pressurized water. Inlet 42 of second leg 36 communicates with an outlet of a cement slurry recirculation pump (not shown), the inlet of which communicates with outlet 54 of tank 46. The outlet of such recirculation pump can also communicate with another device for delivering these cement slurries to the desired location, such as the inlet of a triplex pump as might be used in an oil well cementing operation. By-pass leg 38 may optionally be arranged to communicate with an inlet of an alternate mixing apparatus, for example a known cement eductor-type mixer, while inlet 58 of pipe 56, in such case, would then communicate with the outlet of such alternate mixing apparatus. A source of powdered cement, which is normally a metered source (e.g. controlled by a suitable valve), is arranged to communicate with inlet 6 of conduit 4.

In normal operation, valve 40 would be in an open position while valve 44 would be in a closed position. Water would enter inlet 12 of volute 10, from first leg 31, along with any recirculated slurry from second leg 36. Both the water and recirculated slurry would therefore enter a volute 10 tangentially. In particular, the water would enter volute 10 at a high velocity due to the pressure drop which will occur across nozzle 32. Providing the flow rate of water and/or recirculated slurry into volute 10 through inlet 12 is sufficient, then a vortex will be created within volute 10 which can extend down through transition cone 20. As the water moves through transition cone 20, it will tend to educt particulate cement through outlet 8 of conduit 4. In addition, due to the inward and downward taper of lower portion 23 of transition cone 20, the water and/or recirculated slurry mixture is forced to move inward in a path of convergence with particulate cement passing through outlet 8, thereby facilitating mixture of the particulate cement with the water and/or recirculated slurry mixture. The vortex action which will likely also extend at least partially down into downpipe 26, will also facilitate such mixing. The resulting mixture is discharged from outlet 28 of down pipe 26 above an upper end 50 of tank bottom wall 48. However, as mentioned earlier, distance 66 should be sufficient so that the resulting mixture will not impinge upon bottom wall 48 with sufficient force to produce any substantial splashback into down pipe 26. As a result, dry particulate cement which is exiting outlet 8, will not likely become wetted by any such splashback to effect agglomeration of dry cement particles at outlet 8. If any substantial amount of such agglomeration should occur, there is the possibility that the mixer, and in particular outlet 8, could become clogged with agglomerated cement. Furthermore, if there was any substantial splashback from bottom wall 48 into down pipe 26, the vortex within downpipe 26 might be reduced as a result of such substantial splashback, thereby possibly impeding mixing within downpipe 26.

When the mixing apparatus is initially started, any mixture exiting down pipe outlet 28 will flow downward onto tank bottom wall 48, through gap 62 under baffle 60, and into tank outlet 54. The downsloping arrangement of tank bottom wall 48 and the provision of gap 62, thereby assist in maintaining the prime of a pump which might have its inlet connected to tank outlet 54. In addition, when a particular job is finished, the foregoing arrangement ensures that tank 46 can be emptied of cement slurry. However, normally outlet 54 will receive most of its cement from overflow above baffle 60.

As previously mentioned, cement slurry can be drawn off from the outlet of the recirculation pump, at a desired rate. Obviously, if it is desired to increase the rate at which such slurry is drawn off, without depleting the amount of slurry in tank 46, then the rate at which water is supplied through nozzle 32 and dry cement supplied through inlet 6, must be increased proportionally. In this regard, while the outlet 34 of nozzle 32, should be as small as possible to allow for the greatest pressure drop and hence maximum velocity of water leaving nozzle 30, it must be sufficiently large so as to be able to provide the required water flow rate through, bearing in mind the maximum water pressure which may be supplied through first leg 31 from a typical water pump. Thus for example, while a ¾" size of nozzle opening 34 could deliver approximately 115 gallons per minute of water at 100 psi back pressure, a 1" size of opening 34 would be required to deliver approximately 265 gallons per minute at the same back pressure.

A mixing apparatus of the above-described type was constructed. The apparatus had a minimum diameter of volute 10 of approximately 10", a transition cone 20 of approximately 11" in length (upper portion 22 being 10" wide and 5" long, with lower portion 23 tapering from 10" to 6" diameter at lower end 23 thereof), and with downpipe 26 having a 6" inside diameter and 19" length. The center of downpipe outlet 8 was spaced approximately 12" above tank bottom wall 48. In a number of trials, a nozzle 32 was used with an opening 34 diameter of approximately 1". Class H Portland cement slurries were prepared in accordance with the procedure described above, with densities of the slurries between 16.5 and 17.7 pounds per gallon (as measured at atmospheric pressures). Such slurries were withdrawn from tank outlet 54 at rates of between 1.5 to 9.2 barrels per minute ("bpm") for slurries at the lower end of the foregoing density range, and at varying rates (including 8.5 bpm) for slurries. In further tests with such a mixing apparatus, various cement slurries were prepared at rates from 0.5 bpm to 4 bpm, and 8 to 12 bpm. In all cases, slurries of good consistency resulted without any apparent clogging of mixer 2.

Various modifications and alterations to the above embodiments will be apparent to those skilled in the art without departing from the scope of the invention. Accordingly, the scope of the present invention should be determined with reference to the attached claims.

I claim:

1. A mixer suitable for mixing a particulate material with at least one of a liquid and a slurry, comprising:

(a) a particulate material conduit having a particulate material inlet at an upper end thereof, and a particulate material outlet at a lower end thereof;

(b) a volute chamber disposed about the particulate material conduit, between the inlet and outlet thereof, the volute chamber having:

(i) a combined slurry and liquid inlet (ii) an open lower end through which the particulate material conduit extends, the open lower end and the particulate material conduit together defining an annular combined slurry and liquid outlet;

the combined slurry and liquid inlet and outlet being disposed so that at least one of liquid and slurry entering the combined slurry and liquid inlet at sufficient velocity can leave the combined slurry and liquid outlet in the form of a vortex;

(c) a transition cone concentric with, outside of, and communicating with the combined slurry and liquid outlet of the volute chamber, and extending downward therefrom, the transition cone having a tapered portion starting above the combined slurry and liquid outlet and ending below it; and (d) a combined slurry and liquid conduit communicating with the combined slurry and liquid inlet of the volute chamber, the combined slurry and liquid conduit having:

(i) a liquid carrying leg;

(ii) a nozzle disposed in the liquid carrying leg and aimed at the combined slurry and liquid inlet of the volute chamber so as to direct liquid flowing in the liquid carrying leg into the combined slurry and liquid inlet of the volute chamber; and (iii) a slurry carrying leg, said slurry carrying leg joining with the liquid carrying leg, surrounding the nozzle and mating with the combined slurry and liquid inlet of the volute chamber, whereby slurry flowing in the slurry carrying leg enters the combined slurry and liquid inlet of the volute chamber.

2. A mixer as defined in claim 1, wherein the particulate material conduit, the volute chamber, and the transition cone are all coaxial.

3. A mixer as defined in claim 1 wherein the nozzle is coaxial with the liquid inlet of the volute chamber.

4. A mixing apparatus suitable for mixing a particulate material with at least one of a liquid and a slurry, comprising:

(a) a tank having a bottom wall; and (b) a mixer having:

(i) a particulate material conduit having a particulate material inlet at an upper end thereof, and a particulate material outlet at a lower end thereof;

(ii) a volute chamber disposed about the particulate material conduit, between the inlet and outlet thereof, the volute chamber having a combined slurry and liquid inlet, and having an open lower end through which the particulate material conduit extends, the open lower end and the particulate material conduit together defining an annular combined slurry and liquid outlet;

the combined slurry and liquid inlet and outlet being disposed so that at least one of liquid and slurry entering the combined slurry and liquid inlet at sufficient velocity can leave the combined slurry and liquid outlet in the form of a vortex;

(iii) a transition cone concentric with, outside of, and communicating with the combined slurry and liquid outlet of the volute chamber, and extending downward therefrom, the transition cone having a tapered portion starting above the combined slurry and liquid outlet and ending below it; and (iv) a combined slurry and liquid conduit communicating with the combined slurry and liquid inlet of the volute chamber, the combined slurry and liquid conduit having a liquid carrying leg and a nozzle disposed in the liquid carrying leg and aimed at the combined slurry and liquid inlet of the volute chamber so as to direct liquid flowing in the liquid carrying leg into the combined slurry and liquid inlet of the volute chamber, and a slurry carrying leg, said slurry carrying leg joining with the liquid carrying leg, surrounding the nozzle and mating with the combined slurry and liquid inlet of the volute chamber, whereby slurry flowing in the slurry carrying leg enters the combined slurry and liquid inlet of the volute chamber.

5. An apparatus as defined in claim 4 wherein the nozzle is coaxial with the liquid inlet of the volute chamber.

6. A mixing apparatus as defined in claim 5 wherein the transition cone of the mixer, first extends straight downward from the liquid outlet of the volute chamber, to the tapered portion.

7. An apparatus as defined in claim 1, wherein the particulate material conduit, the volute chamber, and the transition cone are all coaxial.

8. A mixer as defined in claim 1, further comprising a substantially straight downpipe connected to, and extending downward from, a lower end of the transition cone.

9. A mixer as defined in claim 8, wherein the particulate material conduit, the volute chamber, the transition cone, and the downpipe are all coaxial.

10. A mixer as defined in claim 1, wherein at least a portion of said transition cone tapers inward while extending downward from a position not substantially lower than the particulate material conduit outlet, to a position which is not substantially above the particulate material conduit outlet.

11. A mixing apparatus as defined in claim 4, further comprising a substantially straight downpipe connected to, and extending downward from, a lower end of the transition cone.

12. A mixing apparatus as defined in claim 11, wherein the downpipe is spaced above the bottom wall of the tank a sufficient distance such that during operation of the apparatus to produce a vortex in the downpipe no substantial splashback will occur from the bottom wall of the tank into the downpipe.

13. An apparatus as defined in claim 11, wherein the particulate material conduit, the volute chamber, the transition cone, and the downpipe are all coaxial.

14. A mixer as defined in claim 4, wherein at least a portion of said transition cone tapers inward while extending downward from a position not substantially lower than the particulate material conduit outlet, to a position which is not substantially above the particulate material conduit outlet.

* * * * *